US009254055B2

(12) United States Patent
Wong

(10) Patent No.: US 9,254,055 B2
(45) Date of Patent: Feb. 9, 2016

(54) STAND FOR SUPPORTING A POLE WITHIN A BASE

(71) Applicant: Yat Cho Wong, Sham Tseng (HK)

(72) Inventor: Yat Cho Wong, Sham Tseng (HK)

( * ) Notice: Subject to any disclaimer, the term of this patent is extended or adjusted under 35 U.S.C. 154(b) by 0 days.

(21) Appl. No.: 13/904,054

(22) Filed: May 29, 2013

(65) Prior Publication Data

US 2014/0353456 A1 Dec. 4, 2014

(51) Int. Cl.
*A47G 33/12* (2006.01)
*E04H 12/22* (2006.01)

(52) U.S. Cl.
CPC ..... *A47G 33/12* (2013.01); *A47G 33/1206* (2013.01); *E04H 12/22* (2013.01); *E04H 12/2238* (2013.01)

(58) Field of Classification Search
CPC ... A47G 33/12; A47G 33/1206; F16M 11/32; E04H 12/2238; E04H 12/2246; E04H 12/22
USPC ..... 248/163.1, 431, 435, 168, 440.1, 188.7, 248/188.8, 188.6, 158, 418, 524, 519, 521, 248/525, 526, 523, 528, 588, 169, 177, 248/166; 47/40.5, 175, 511
See application file for complete search history.

(56) References Cited

U.S. PATENT DOCUMENTS

| | | | | | |
|---|---|---|---|---|---|
| 871,050 | A | * | 11/1907 | Vogt | 248/511 |
| 1,923,794 | A | * | 8/1933 | Noland | 47/40.5 |
| 2,670,163 | A | * | 2/1954 | Armitage | 248/524 |
| 2,699,308 | A | * | 1/1955 | Shackelford | 248/524 |
| 2,706,609 | A | * | 4/1955 | Sullivan | 248/167 |
| 3,787,018 | A | * | 1/1974 | Nathan | 248/165 |
| 3,888,438 | A | | 6/1975 | Mizelle | |
| 4,288,052 | A | * | 9/1981 | Scott | 248/188.6 |
| 4,406,437 | A | * | 9/1983 | Wright | 248/529 |
| 4,763,866 | A | * | 8/1988 | Sinchok | 248/188.7 |
| 4,801,123 | A | * | 1/1989 | Lynch | 248/524 |
| 5,022,620 | A | * | 6/1991 | Scott | 248/188.6 |
| 5,236,167 | A | * | 8/1993 | Tai et al. | 248/529 |
| 5,290,004 | A | * | 3/1994 | Frost et al. | 248/528 |
| 5,871,185 | A | * | 2/1999 | Phillips et al. | 248/167 |
| RE36,640 | E | * | 4/2000 | Frost et al. | 248/528 |
| 6,138,977 | A | * | 10/2000 | Tsai | 248/523 |
| 6,234,443 | B1 | * | 5/2001 | Tsai et al. | 248/519 |
| 6,293,512 | B1 | * | 9/2001 | Ho | 248/579 |
| 6,491,266 | B1 | * | 12/2002 | Chen | 248/163.1 |
| 6,688,565 | B1 | * | 2/2004 | Chen | 248/166 |
| 7,364,130 | B2 | * | 4/2008 | Lai | 248/519 |

(Continued)

FOREIGN PATENT DOCUMENTS

| | | | |
|---|---|---|---|
| CN | 341512 | Y | 10/1999 |
| CN | 2582491 | Y | 10/2003 |
| CN | 201452769 | U | 5/2010 |

*Primary Examiner* — Nkeisha Smith

(57) ABSTRACT

A stand for a Christmas tree or the like is adapted to cooperate with a base portion of a pole such as a tree trunk to provide a stable support for the pole with its base spaced above a support surface such as a floor. The stand comprises a plurality of support members each having a proximal end spaced above the support surface. The proximal ends of the support members cooperate to form a clamp for receiving the base portion of the pole. The clamp is arranged such that, when the base portion of the pole is received in the clamp, one or more of the support members pivots at its proximal end about the clamp to thereby cause the clamp to close and grip the base portion of the pole. The weight of the pole may be sufficient to cause the clamp of the stand to automatically grip the pole.

7 Claims, 8 Drawing Sheets

(56) References Cited

U.S. PATENT DOCUMENTS

D628,411 S * 12/2010 Lucht ..... D6/495
2005/0121591 A1* 6/2005 Tsai ..... 248/523
2009/0039230 A1* 2/2009 Cheng ..... 248/523
2014/0291472 A1* 10/2014 Leung ..... 248/524

* cited by examiner

STAND FOR SUPPORTING A POLE WITHIN A BASE

FIELD OF THE INVENTION

The invention relates to an improved stand adapted to cooperate with a base portion of a pole to provide a stable support for the pole with its base spaced above a support surface. The invention relates more particularly, but not exclusively, to a stand for an artificial Christmas tree or the like where the stand is adapted to receive and automatically clamp a lower portion of the Christmas tree pole.

BACKGROUND OF THE INVENTION

Stands for supporting both natural Christmas trees and artificial Christmas trees are known. In most known stands, the stands include means adapted to loosely receive a base portion of the tree pole or trunk. In order to then stably support the Christmas tree, the stands includes means for fixedly securing the tree pole to the stand. Such means often comprise one or more manually operated screws or the like provided at or adjacent to the means for receiving the lower portion of the tree pole where the screws must be driven into the material of the tree pole to fix it to the stand.

There are a number of disadvantages with known tree stands. One such problem is that the stands are often not easily collapsible for transport or storage purposes. Or, where they are collapsible, it often requires that they are disassembled into multiple separate parts for storage with the danger that one or more of such parts becomes mislaid. Another problem is that the fixture means such as screws for fixedly securing the tree pole to the stand may damage the material of the pole. This is not an issue in the case of cut natural Christmas trees which are normally disposed of after use, but it can become a problem with artificial trees which may be used time and time again.

OBJECTS OF THE INVENTION

An object of the invention is to mitigate or obviate to some degree one or more problems associated with known stands.

The above object is met by the combination of features of the main claims; the sub-claims disclose further advantageous embodiments of the invention.

Another object of the invention is to provide a stand that is easily collapsible for transport and/or storage purposes and does not require dismantling into multiple separate parts for storage.

Another object is to provide a stand that does not require fixture means such as screws, bolts or the like for stably supporting a tree or the like in the stand.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a stand adapted to cooperate with a base portion of a pole such as a tree trunk to provide a stable support for the pole with its base spaced above a support surface such as a floor. The stand comprises a plurality of support members each having a proximal end spaced above the support surface. The proximal ends of the support members cooperate to form a clamp for receiving the base portion of the pole. The clamp is arranged such that, when the base portion of the pole is received in the clamp, one or more of the support members pivots at its proximal end about the clamp to thereby cause the clamp to close and grip the base portion of the pole. The clamp may be such that the weight of the pole acting on the clamp is sufficient in itself to cause one or more of the support members to pivot at its proximal end to cause the clamp to automatically close and grip the base portion of the pole. Preferably, the clamp is arranged such that, when the base portion of the pole is received in the clamp, the weight of the pole acting on a lower part of the clamp causes one or more of the support members to pivot at its proximal end about the lower part of the clamp to thereby cause an upper part of the clamp to close and grip the base portion of the pole.

Preferably, each of the plurality of support members has a generally planar form and the support members are movably coupled to each other such that, when not in use, they can be moved to lie one above the other in a collapsed state for transport or storage.

In a second main aspect, the invention provides a support member for a stand according to the invention.

In a third main aspect, the invention provides a kit of parts for assembling a stand according to the invention.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 3:
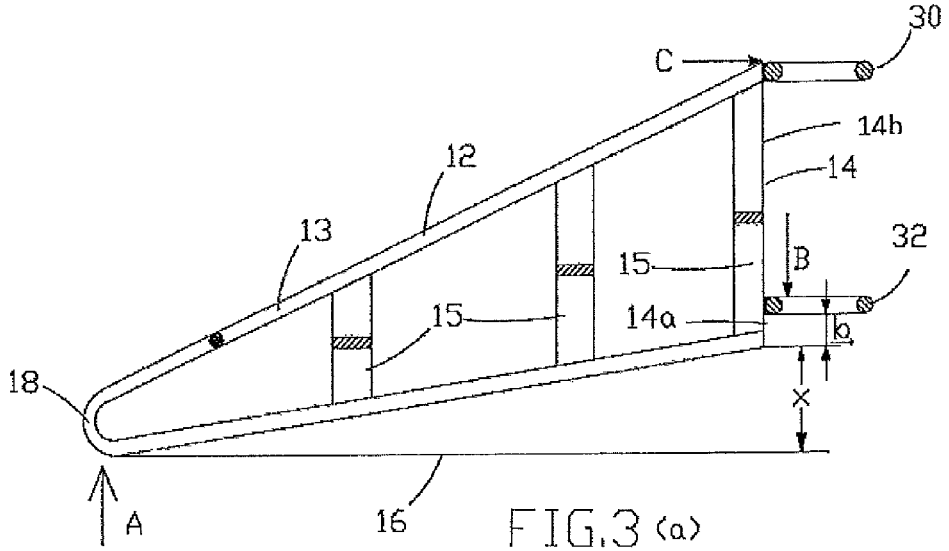
FIGS. 3(*a*) and (*b*) comprise side and top views of a first one of the support members of the stand of FIG. 1.
Figure 3:
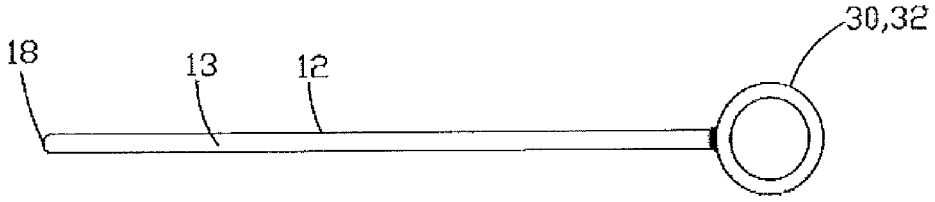
Figure 4:
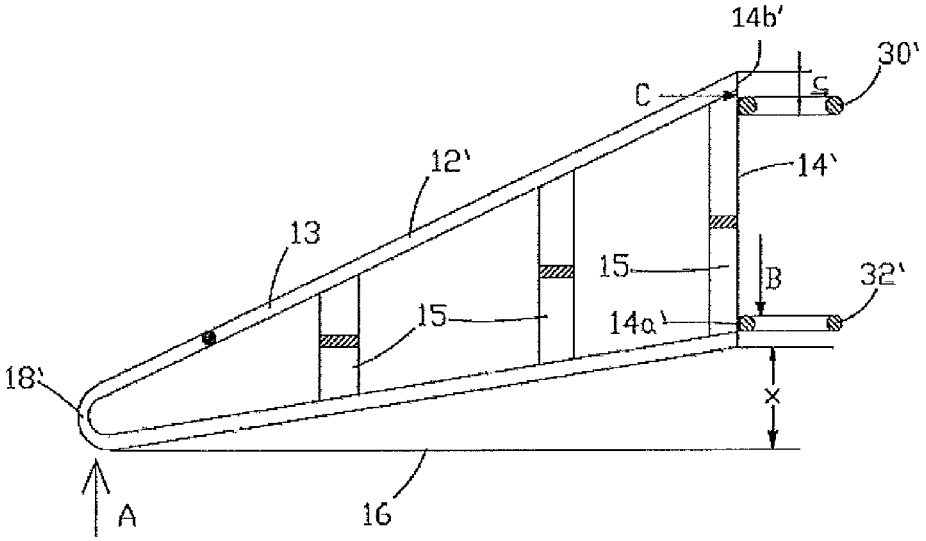
FIGS. 4(*a*) and (*b*) comprise side and top views of a second one of the support members of the stand of FIG. 1.
Figure 4:
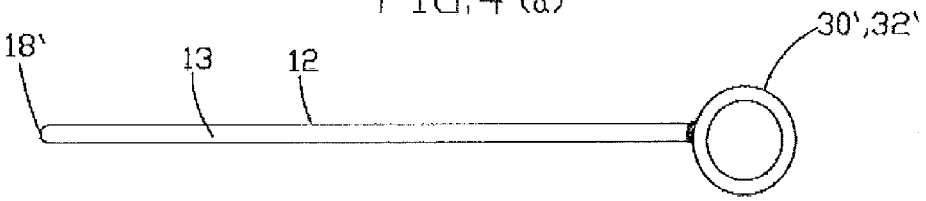
Figure 5:
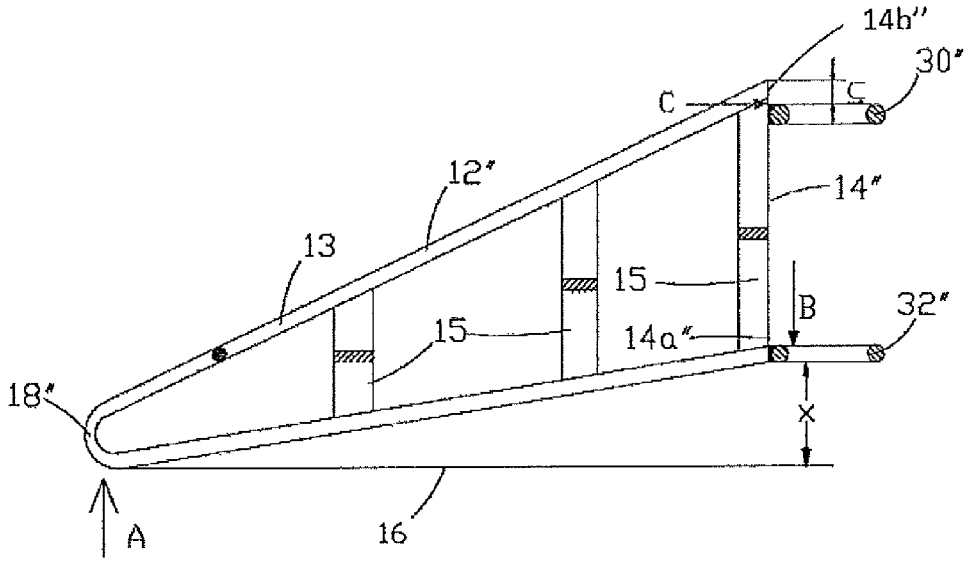
FIGS. 5(*a*) and (*b*) comprise side and top views of a third one of the support members of the stand of FIG. 1.
Figure 5:
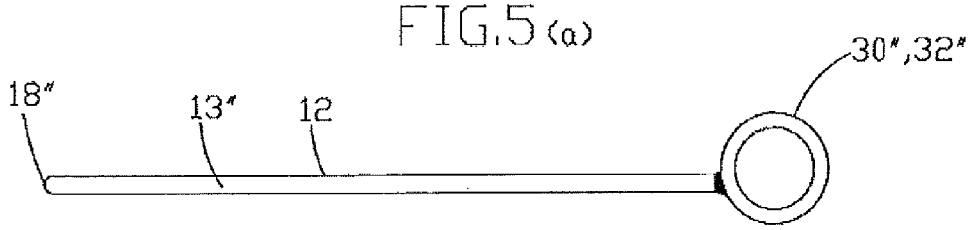

Referring to the drawings, a stand 10 according to the invention comprises a plurality of support members 12, 12', 12" each having a proximal end 14, 14', 14" arranged adjacent to a central part of the stand 10 and spaced above a support surface 16 such as a floor. The proximal ends 14, 14', 14" of the support members 12, 12', 12" are spaced a distance X (as seen in FIGS. 3 to 5) in the order of 40 mm above the support surface 16, although in other embodiments the distance X may be greater or smaller than 40 mm. Respective distal ends 18, 18', 18" of the support members 12, 12', 12" rest on the support surface 16. The support members 12, 12', 12" are arranged around the central part of the stand 10 such that their respective distal ends 18, 18', 18" are radially spaced apart from each other surrounding said central part of the stand 10. The stand 10 is adapted to cooperate with a base portion 20 (shown in broken outline in FIG. 1) of a pole such as a tree trunk to provide a stable vertical support for the pole with its base spaced above the support surface 16. The base portion 20 of the pole is received, in use, in the central part of the stand 10.

In the preferred embodiment shown in the drawings, the stand 10 is provided with three support members 12, 12', 12" arranged in a tripod configuration. This offers the advantage that the stand 10 will be self-leveling, but it will be understood that the stand 10 may be provided with a greater number of support members in other embodiments.

Each support member 12, 12', 12" has a generally triangular planar form with its proximal end 14, 14', 14" having a much greater vertical depth than its distal end 18, 18', 18". The distal end 18, 18', 18" of each support member preferably tapers generally to a rounded point which acts as a foot and a fulcrum point (indicated by arrowed lines A in FIGS. 3 to 5) for its support member 12, 12', 12", although any part of a support member spaced away from its proximal end and contacting the support surface can act as the fulcrum of a lever comprising the support member.

Each support member 12, 12', 12" may be formed from a generally triangular wire frame member 13 with a plurality of vertical stays 15 providing some rigidity to the wire frame member 13. The support members 12, 12', 12" may be formed from steel components welded together or may be formed as an integrally moulded plastics member.

The proximal ends 14, 14', 14" of the support members 12, 12', 12" are coupled to each other at the central part of the stand 10 to form a two part clamp mechanism 22 for receiving the base portion 20 of the pole.

Each support member 12, 12', 12" is arranged in the stand 10 such that it acts as a lever for the clamp mechanism 22 with a lower part of its proximal end 14*a*, 14*a*', 14*a*" comprising a force point (indicated by arrowed lines B in FIGS. 3 to 5) of the lever and an upper part of its proximal end 14*b*, 14*b*', 14*b*" acting as a load point (indicated by arrowed lines C in FIGS. 3 to 5) of the lever. It will be appreciated that in some embodiments it is only necessary to arrange for one or more, but not necessarily all, of the support members to act as levers for the clamp mechanism 22.

The clamp mechanism 22 comprising the coupled proximal ends 14, 14', 14" of the support members 12, 12', 12" is arranged such that, when the base portion 20 of the pole is received in the clamp mechanism 22, the weight of the pole acting on the clamp mechanism may cause said support members 12, 12', 12" to automatically pivot about their proximal ends 14, 14', 14" about the clamp mechanism 22 to thereby cause the clamp mechanism 22 to automatically close and grip the base portion 20 of the pole. In some embodiments, a manual downward force applied to the pole may help the clamp mechanism to automatically close to grip the lower portion 20 of the pole.

More specifically, when the base portion 20 of the pole is received in the clamp mechanism 22, the weight of the pole 20 acting on a lower part 22*a* of the clamp mechanism 22 or the weight of the pole assisted by some downward manual force applied to the pole causes the support members 12, 12', 12" to pivot about their lower proximal end parts 14*a*, 14*a*', 14*a*" to thereby cause their upper proximal end parts 14*b*, 14*b*', 14*b*" to close inwardly at the central part of the stand 10 and grip the base portion 20 of the pole.

Advantageously, the pole such as a trunk of an artificial Christmas tree or the like may be automatically clamped in the stand 10 through dint of its own weight. Even where the stand 10 requires some downward manual force to be applied to the pole to cause automatic closure of the clamp mechanism 22, the stand 10 according to the invention does not require any manual operation of a separate fixture means such as screws, bolts or the like to stably support the pole in the stand 10. Furthermore, the automatic gripping of the base portion 20 of the pole by the clamp mechanism 22 is itself sufficient to stably support the pole on the stand 10 such that there is no need to provide the stand with any additional fixture means other than the clamp mechanism 22 for stably supporting the pole in the stand.

To comprise the clamp mechanism 22, the proximal end 14, 14', 14" of each support member 12, 12', 12" comprises an upper ring member 30, 30', 30" and a lower ring member 32, 32', 32". The upper ring members 30, 30', 30" cooperate to form the upper part 22*b* of the clamp mechanism 22 and the lower ring members 32, 32', 32" cooperate to form the lower part 22*a* of the clamp mechanism 22.

Figure 1:
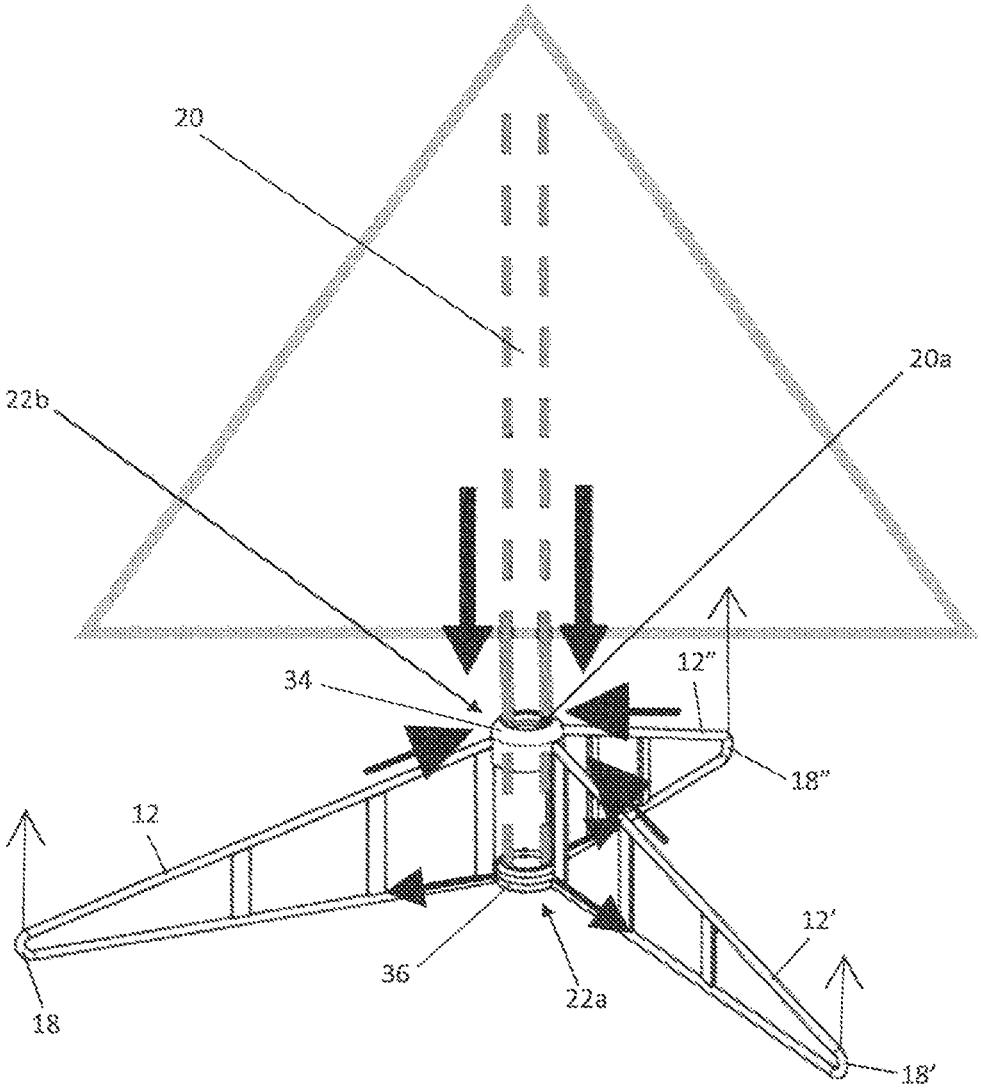
FIG. 1 is a perspective view of a stand according to the invention in an erected condition.
Figure 2:
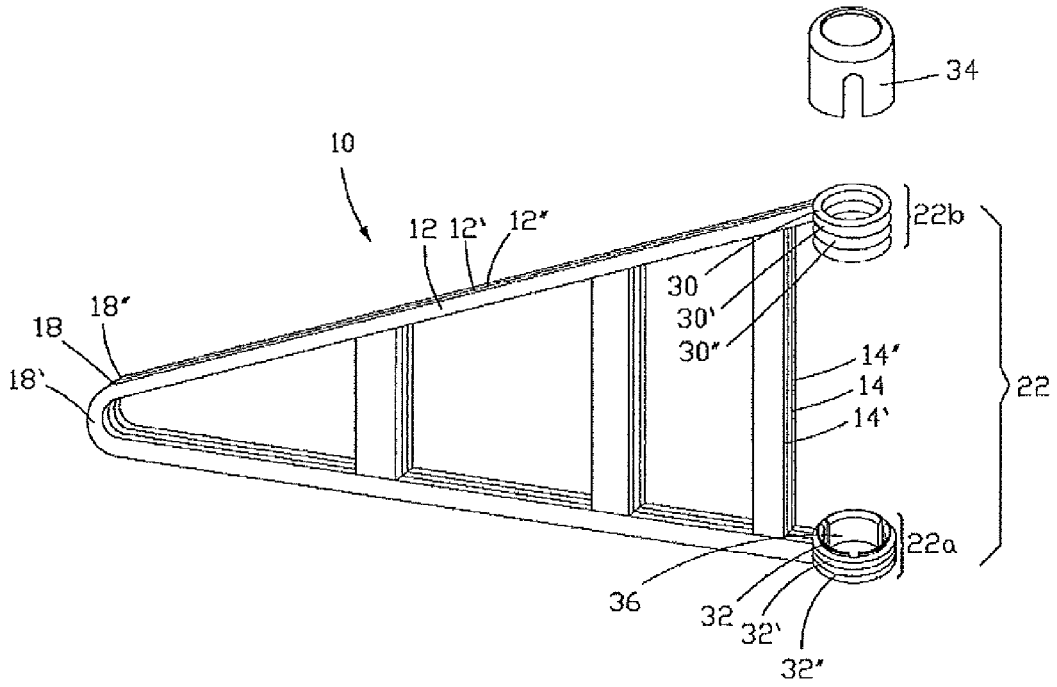
FIG. 2 is a perspective view of the stand of FIG. 1 in a collapsed condition ready for storage.

Whilst the support members 12, 12', 12" are generally similar in structure, their proximal ends 14, 14', 14" differ in the positioning of the upper and lower ring members in order to allow said ring members to be rotatably coupled as shown in FIGS. 1 and 2. Referring to FIG. 3, it can be seen in FIG. 3(*a*) that the first support member 12 of the stand 10 has its upper ring member 30 positioned at the highest most point on its proximal end 14, whereas its lower ring member 32 is positioned a distance a above the lowest most point on the proximal end 14. The distance a is equal to the combined depths of the of the lower ring members 32', 32" of the second and third support members 12', 12". In FIG. 3(*b*), it can be seen that the wire frame member 13 of the first support member 12 is attached to the upper and lower ring members 30, 32 on a line passing through their centre points.

Referring to FIG. 4, it can be seen in FIG. 4(*a*) that the second support member 12' of the stand 10 has its upper ring member 30' positioned a distance b below the highest most point on its proximal end 14' and its lower ring member 32' positioned by the same distance b above the lowest most point on the proximal end 14'. The distance b is equal to the depth of a ring member. In FIG. 4(*b*), it can be seen that the wire frame member 13 of the second support member 12' is attached to the upper and lower ring members 30', 32' on a line which is offset by a distance of half of the width of the wire frame member 13 from a line passing through their centre points.

Referring to FIG. 5, it can be seen in FIG. 5(*a*) that the third support member 12" of the stand 10 has its upper ring member 30" positioned a distance c below the highest most point on the proximal end 14", whereas its lower ring member 32" is positioned at the lowest most point on the proximal end 14". The distance c is equal to the combined depths of two ring members'. In FIG. 5(*b*), it can be seen that the wire frame member 13 of the third support member 12" is attached to its upper and lower ring members 30", 32" on a line which is offset by a distance of half of the width of the wire frame member 13 from a line passing through their centre points.

Consequently, it will be appreciated that the upper and lower ring members of the support members 12, 12', 12" are positioned on their respective proximal ends 14, 14', 14" such that, when the three support members are laid in a coplanar arrangement as shown in FIG. 2, the upper ring members interleave to form the upper part 22*b* of the clamp mechanism and the lower ring members interleave to form the lower part 22*a* of the clamp mechanism 22.

Figure 7:
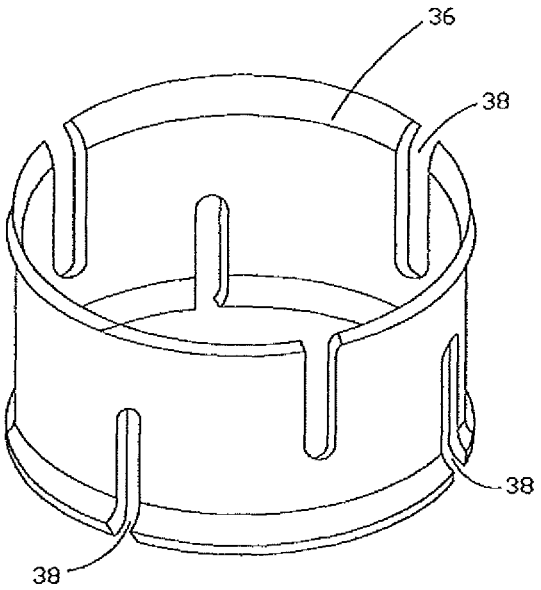
FIGS. 7(*a*), (*b*), (*c*) and (*d*) comprise perspective, top, cross-sectional side and bottom views of a collar for the stand of FIG. 1.
Figure 7:
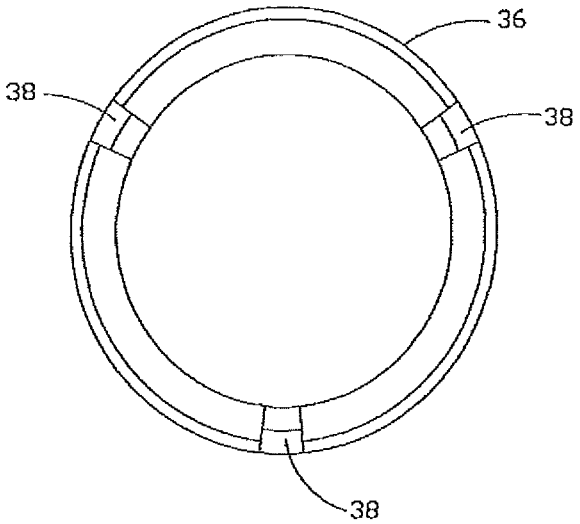
Figure 7:
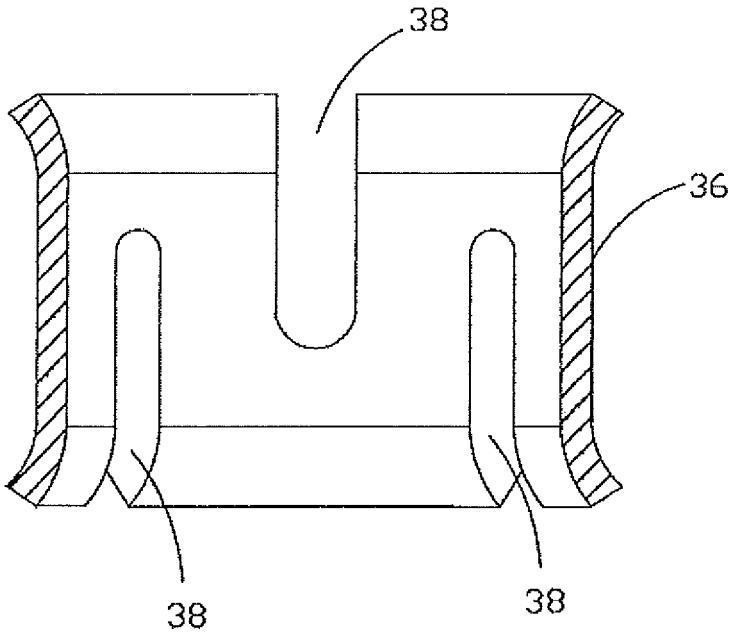
Figure 7:
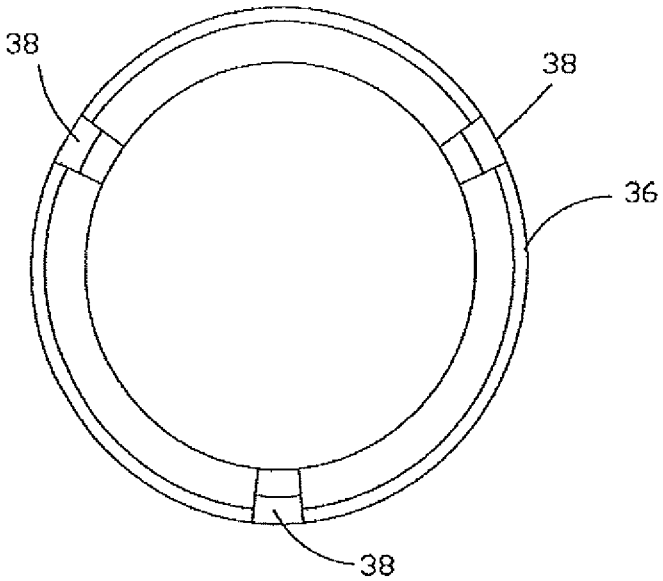

A collar member 36 is provided to rotatably support the lower ring members 32, 32', 32" of the support members. The collar member 36 is, in use, inserted through the apertures of the interleaved lower ring members 32, 32', 32". The collar member 36 as is best seen in FIGS. 7(*a*) to 7(*d*) comprises a generally cylindrical member preferably formed from an elastic material such as a plastics material. The collar member 36 has a plurality of spaced apart U-shaped slots 38 formed in both its upper and lower edges which extend to approximately half the depth of the collar member 36. Furthermore, the upper and lower edges are preferably splayed outwardly to thereby provide an elastic retention means for retaining the collar member 36 in place rotatably coupling the lower ring members.

The collar member 36 has a number of functions. In addition to rotatably coupling the lower ring members 32, 32', 32" such that the support members 12, 12', 12" can be rotated between the collapsed condition of the stand 10 as shown in FIG. 2 and the erected condition of the stand 10 as shown in FIG. 1, its elasticity also enables the lower ring members 32, 32', 32" to pivot upwardly with respect to each other thereby causing the upper ring members 30, 30', 30" forming the upper part 22*b* of the clamp mechanism 22 to close inwardly on each other. Another function of the collar member 36 is to provide the load points B for the support members and it does this by receiving a force exerted by the base of the pole on its upper splayed edge. In a preferred embodiment of the stand 10 for stably supporting, for example, an artificial Christmas tree, the base portion 20 of the pole of the tree is formed with a reduced width lower portion as shown in FIG. 1 thereby presenting a shoulder portion 20*a*. In use, the shoulder portion 20*a* of the pole base portion engages the upper splayed edge of the collar member 36 such that a downward force exerted by the pole 20 acts through the shoulder portion 20*a* onto the upper splayed edge of the collar member 36 and is transferred onto the lower ring members 32, 32', 32" of the support members 12, 12', 12" causing pivoting of said support members.

Figure 6:
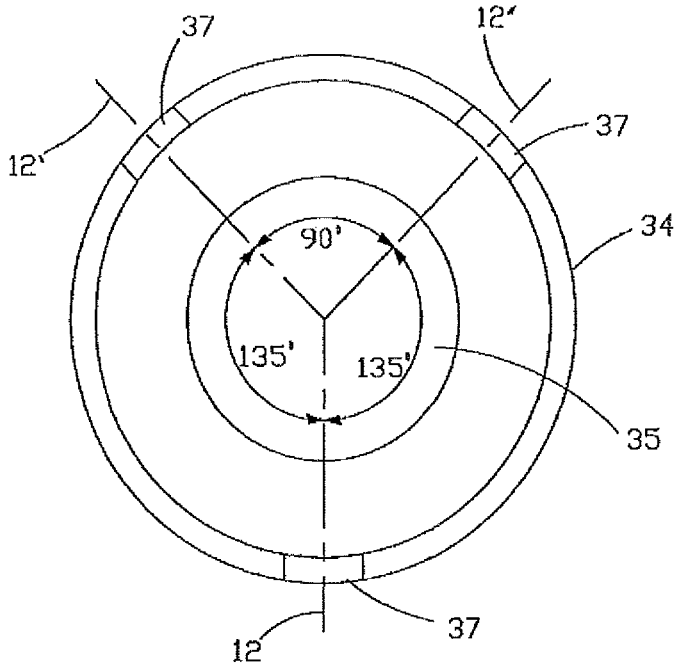
FIGS. 6(*a*) and (*b*) comprise top and cross-sectional side views of a cap for the stand of FIG. 1.
Figure 6:
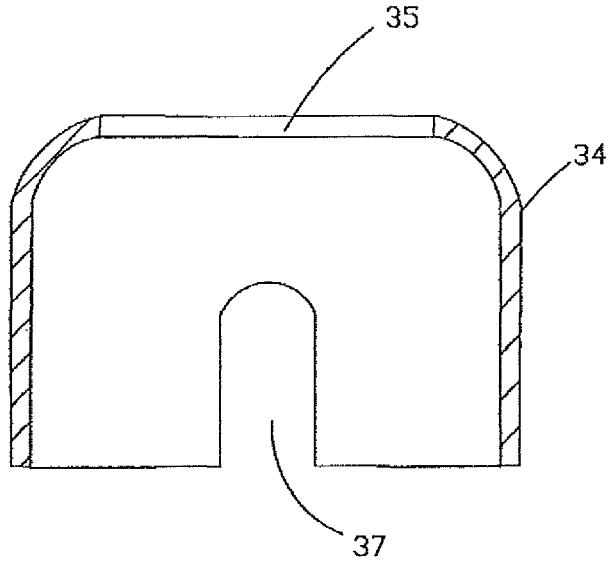

To complete the stand 10, a cap member 34 as seen in FIGS. 6(*a*) and 6(*b*) is provided such that, when the support members 12, 12', 12" are spaced apart so as to radially surround the clamp mechanism 22 in a tripod configuration, the cap member 34 is placed on upper parts of the proximal ends 14, 14', and 14" of the support members to hold them in their radially spaced-apart arrangement. The cap member 34 has a central aperture 35 in its upper wall to receive, in use, the base portion 20 of the pole. It also is provided with a plurality of spaced apart U-shaped slots 37 in its lower edge, the slots 37 being adapted to fit over upper parts of the wire frame members 13 when the support members are arranged in the erected condition of the stand 10 as seen in FIG. 1.

Whilst in the preferred embodiment, the plurality of support members 12, 12', 12" are radially spaced apart so as to surround the central part of the stand 10, i.e. the clamp mechanism 22, the support members 12, 12', 12" need not be equally radially spaced around the clamp as this is not essential to the function of the stand 10. For example and as illustrated in FIG. 6(*a*), the second and third support members 12', 12" may each be angled at 135 degrees to the first support member 12 and therefore at 90 degrees to each other.

The stand 10 according to the invention can be provided as a kit of parts for self-assembly. The method of assembling the stand 10 involves placing the first support member 12 sandwiched between the second and third support members 12', 12" with their upper and lower ring members interleaved. The collar member 36 is then inserted through the apertures of the lower ring members. The support members 12, 12', 12" can then be rotated about the collar member 36 to take up the radially separated positions for the stand 10 in its erected condition at which point the cap member 34 can be placed onto the support members 12, 12', 12" to secure them in their radially spread apart state.

Once the stand 10 is made ready as described above, a base portion 20 of a tree support pole can be inserted through the aperture 35 of the cap member 34 to then be received through the upper and lower parts 22*a,b* of the clamp mechanism 22, i.e. through the apertures of the upper and lower ring members. A shoulder portion 20*a* of the pole engages the upper splayed edge of the collar member 36 in the lower clamp part 22*a* thereby causing the support members to pivot such that the upper ring members 30, 30', 30" close inwardly on each other and clamp the pole.

In general, there is provided a stand adapted to cooperate with a base portion of a pole such as a tree trunk to provide a stable support for the pole with its base spaced above a support surface such as a floor. The stand comprises a plurality of support members each having a proximal end spaced above the support surface. The proximal ends of the support members cooperate to form a clamp for receiving the base portion of the pole. The clamp is arranged such that, when the base portion of the pole is received in the clamp, the weight of the pole acting on the clamp causes one or more of the support members to pivot at its proximal end about the clamp to thereby cause the clamp to close and grip the base portion of the pole.

To make the erected stand 10 ready for storage, all that need be done is to remove the cap member 34 and then rotate the support members 12, 12', 12" to the collapsed condition shown in FIG. 2. There is no need to remove the collar member 36.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A stand adapted to cooperate with a base portion of a pole to provide a stable support for the pole with a base portion of the stand spaced above a support surface, the stand comprising:

a plurality of support members each having a proximal end spaced above the support surface, the proximal ends of the support members comprising a clamp for receiving the base portion of the pole; each proximal end comprises an upper ring member and a lower ring member; the upper ring members of the plurality of support members each comprises a ring-shaped member, said ring-shaped members cooperate to form an upper part of the clamp wherein said upper part of the clamp thereby comprises a plurality of individual ring-shaped members, and the lower ring members of the plurality of support members cooperate to form a lower part of the clamp; the clamp being arranged such that, when the base portion of the pole is received in the clamp, a weight of the pole acting on the lower part of the clamp causes at least one of the support members to pivot at its proximal end about the lower part of the clamp to thereby cause the plurality of ring-shaped members of the upper part of the clamp to close inwardly and grip the base portion of the pole.

2. The stand of claim 1, wherein the at least one of the support members is arranged in the stand such that the at least one of the support members acts as a lever for the clamp with a lower part of its proximal end comprising a force point of the lever, an upper part of its proximal end acting as a load point of the lever and a part of the at least one of the support members is spaced away from its proximal end and contacting the support surface acting as a fulcrum of the lever.

3. The stand of claim 1, wherein there is no need to provide the stand with any additional means other than the clamp for stably supporting the base portion of the pole in the stand.

4. The stand of claim 1, wherein each of the plurality of support members has a generally planar form and each of the plurality of support members is movably connected to each other such that, when not in use, each of the plurality of support members can be moved to lie one above an other in a collapsed state for storage.

5. The stand of claim 1, wherein a cap member is provided such that, when the plurality of support members are radially spaced apart so as to comprise the clamp, the cap member is placed on upper parts of the proximal ends of the plurality of support members to hold the plurality of support members in their radially spaced apart arrangement.

6. The stand of claim 1, wherein a collar member is provided to rotatably support the lower rings of the plurality of support members such that, when not in use, the plurality of support members can be rotated about the collar member to a collapsed state for storage.

7. A kit of parts for assembling a stand for a Christmas tree, the kit of parts comprising:

a plurality of support members each having a proximal end adapted to cooperate with proximal ends of other support members to define a clamp for receiving a base portion of a Christmas tree pole, each proximal end comprises an upper ring member and a lower ring member; the upper ring members of the plurality of support members each comprises a ring-shaped member, each ring-shaped members cooperate to form an upper part of the clamp wherein said upper part of the clamp thereby comprises a plurality of individual ring-shaped members, and the lower ring members of the plurality of support members cooperate to form a lower part of the clamp such that, when the base portion of the pole is received in the clamp, a weight of the pole acting on the lower part of the clamp causes at least one of the support members to pivot at its proximal end about the lower part of the clamp to thereby cause the plurality of ring-shaped members of the upper part of the clamp to close inwardly and grip the base portion of the pole.

* * * * *